US009068383B2

(12) United States Patent
Wurst et al.

(10) Patent No.: US 9,068,383 B2
(45) Date of Patent: Jun. 30, 2015

(54) HINGE DEVICE FOR A MOTOR VEHICLE DOOR

(71) Applicant: Klaus Wohlfarth, Fichtenberg (DE)

(72) Inventors: Thomas Wurst, Murrhardt (DE); Gerlando Pace, Murrhardt (DE); Michael Spinner, Fichtenberg (DE)

(73) Assignee: Klaus Wohlfarth, Fichtenberg (DE)

( * ) Notice: Subject to any disclaimer, the term of this patent is extended or adjusted under 35 U.S.C. 154(b) by 0 days.

(21) Appl. No.: 14/262,202

(22) Filed: Apr. 25, 2014

(65) Prior Publication Data

US 2014/0325792 A1 Nov. 6, 2014

(30) Foreign Application Priority Data

May 6, 2013 (DE) ..... 10 2013 208 296
Apr. 9, 2014 (DE) ..... 10 2014 206 825

(51) Int. Cl.
*E05D 3/10* (2006.01)
*E05D 7/00* (2006.01)
*E05D 3/18* (2006.01)

(52) U.S. Cl.
CPC ..... *E05D 7/00* (2013.01); *Y10T 16/532* (2015.01); *E05D 3/10* (2013.01); *E05D 3/18* (2013.01)

(58) Field of Classification Search
CPC ..... E05Y 2900/50; E05Y 2900/531; E05Y 2900/532; E05Y 2201/638; E05D 11/06; E05D 11/062; E05D 11/1057; E05D 3/10; E05D 3/06; E05F 1/1292; E05F 1/1238; E05C 17/38
USPC ..... 16/366, 367, 241, 239, 246, 374; 296/146.11, 146.12, 146.8
See application file for complete search history.

(56) References Cited

U.S. PATENT DOCUMENTS

| | | | | |
|---|---|---|---|---|
| 4,433,507 | A * | 2/1984 | Chikaraishi | 49/213 |
| 6,808,223 | B1 * | 10/2004 | Baum et al. | 296/146.12 |
| 6,820,918 | B1 * | 11/2004 | DeBono | 296/146.11 |
| 7,100,245 | B2 | 9/2006 | Wohlfarth | |
| 7,941,897 | B1 * | 5/2011 | Ham | 16/374 |
| 2003/0213102 | A1 | 11/2003 | Ham | |
| 2005/0166363 | A1 * | 8/2005 | Hoffman | 16/244 |
| 2005/0204511 | A1 * | 9/2005 | Wohlfarth | 16/367 |
| 2006/0123592 | A1 * | 6/2006 | Yip | 16/241 |
| 2006/0175863 | A1 * | 8/2006 | Evans | 296/100.08 |
| 2007/0214606 | A1 * | 9/2007 | Hoffman | 16/367 |
| 2008/0083089 | A1 | 4/2008 | Hoffman | |
| 2009/0056074 | A1 * | 3/2009 | Chase | 16/321 |
| 2009/0106941 | A1 * | 4/2009 | Greenbank | 16/371 |
| 2009/0295187 | A1 * | 12/2009 | Ham | 296/146.11 |

(Continued)

FOREIGN PATENT DOCUMENTS

| | | | |
|---|---|---|---|
| DE | 10 2005 061 978 | B3 | 2/2007 |
| DE | 10 2007 012 265 | A1 | 9/2008 |

*Primary Examiner* — Chuck Mah
(74) *Attorney, Agent, or Firm* — Boyle Fredrickson, S.C.

(57) ABSTRACT

A hinge device for mounting a motor vehicle door on a bodywork is proposed. The hinge device includes a hinge component which is screwed to the vehicle door. By means of two articulated joints, the component is articulated on the bodywork. Each of the two articulated joints has an axis of articulation. The two axes of articulation are intersecting and extending preferably perpendicular to each other. The hinge component to be mounted to the door is provided with a protrusion which is moved, during the opening movement, in a guideway attached to the bodywork. The form of the guideway is decisive for the opening movement of the door.

13 Claims, 11 Drawing Sheets

(56) References Cited

U.S. PATENT DOCUMENTS

2010/0269301 A1* 10/2010 Yip ..... 16/374
2010/0269303 A1* 10/2010 Yip ..... 16/386
2011/0030171 A1 2/2011 Hooton et al.
2011/0138576 A1* 6/2011 Yip ..... 16/371

* cited by examiner

HINGE DEVICE FOR A MOTOR VEHICLE DOOR

BACKGROUND OF THE INVENTION

The invention relates to a hinge device for a motor vehicle door.

Traditionally, doors of motor vehicles are provided with a hinge device having an approximately vertical axis. Thus, the doors are pivoted around said axis from the closed position to swing outwards.

For sportive vehicles, there are also gull-wing doors available, wherein in the vicinity of the upper edge of the door, there is a horizontal axis extending in the longitudinal direction of the motor vehicle to swing the doors outwards in a gull-wing type around said axis.

Likewise well-known are doors that are pivoted around a horizontal axis extending transverse to the longitudinal direction of the vehicle.

Furthermore, there are hinge devices available, in particular intended for retrofitting or modification, which allow that a per se normal vehicle door is pivoted from its closed position initially around an approximately vertical axis to an extent that the door is no longer located within the doorway. Then subsequently, the door is pivoted to swing upwards around a horizontal axis extending transverse to the longitudinal direction of the vehicle.

A hinge device of such a type (US 2003/0213102 A1) has two fitting components, whereof one is fixed to the bodywork and the other to the door of the vehicle. The two fitting components are connected to an articulated joint to allow movements around two axes.

Likewise well-known is a hinge device for a motor vehicle door, wherein two fitting components are hinged to one another by means of a plurality of articulated joints, wherein one joint is disengaged after swinging out of the door such that it is no longer operative (DE 10 2004 024 842 C5).

Another door fitting is similarly designed to include a plurality of articulated joints, wherein to swing the door upwards one joint is decoupled (DE 10 2007 012 265 A1).

In these cases the hinge device has two articulated joints with different axes of articulation.

SUMMARY OF THE INVENTION

An object of the invention is to provide a hinge device for a motor vehicle door by means of which the course of movement of the opening movement of the motor vehicle door and the fitting component associated to the motor vehicle door, respectively, can be controlled more precisely.

To achieve the object, the invention proposes a hinge device having the features as mentioned in claim 1. Further developments of the invention are the subject-matter of dependent claims.

The hinge device thus includes a fitting component which is connected to the door. The fitting component will be designated door fitting component hereinbelow. The hinge device connecting the door fitting component to the vehicle bodywork (car body) includes an articulation device composed of two articulated joints, each including an axis of articulation. Thus, the opening movement of the fitting component associated to the door is a movement composed of the movement around both the axes of articulation. A guiding element disposed on the vehicle bodywork or the door fitting component provides for an accurate setting of the actual movement in cooperation with the guideway.

Indeed, it may be sufficient that the guideway for determination and setting of the exact movement of the vehicle door is present but in those zones of movement where a definition of the movement is particularly crucial. According to the invention, however, it may be provided that the guiding element is in engagement with the guideway during the entire opening movement of the door fitting component. In particular, even the maximum opening movement around the axis of articulation of each of the two articulated joints can be limited thereby.

In principle, the guiding element may be disposed both on the vehicle bodywork and on the door fitting component of the hinge device as proposed by the present invention. In fact, configuring the guiding element on the door fitting component and the guideway on the vehicle bodywork, has proved to be particularly expedient.

In an advanced embodiment of the invention, it can be provided that the axes of articulation of both the articulated joints implemented in the articulation device are oriented perpendicular to each other. Considering the exemplary use case mentioned above, one of the two axes of articulation can be oriented essentially vertical or slightly inclined, corresponding to the opening movement of a normal motor vehicle door, while the second axis of articulation is oriented horizontally.

In another advanced embodiment of the invention, it can be provided that the axes of articulation of both the articulated joints are intersecting in the articulation device.

Thereby, particularly expedient kinematics of the opening movement may be achieved.

In an advanced embodiment of the invention, the guideway can be a groove, that is, a recess with an essentially constant width and bordered on each side by a flank. The guiding element can be guided securely within said groove.

Yet it is also possible and within the scope of the invention, that the guideway is a type of rail and the guiding element fits on the rail, on both sides for example, in such a manner that a portion of the rail is enclosed thereby.

According to the invention, provision can be made that the guiding element is slidably guided in the guideway or along the guideway. For that purpose, the guiding element can include a slider. Matching the materials of the guideway and the slider can arrange for merely low friction occurring.

It has proved particularly convenient, however, to provide the guiding element with at least one pivoted roller adapted to roll on the guideway. Thereby, friction is restricted to the bearing of the roller.

In particular in another advanced embodiment of the invention, it can be provided that the rotary axis of the roller is perpendicular to the axes of articulation of both the articulated joints of the articulation device.

In another embodiment of the invention, it can also be provided that the rotary axis of the roller intersects the intersection point of the axes of articulation of both the articulated joints of the articulation device.

In the above mentioned use case, one axis of articulation is extending vertically and the other axis of articulation horizontally. It is well conceivable that even a still more sophisticated movement of the door should be allowed. Such a feature can be achieved in that the articulation device has a third axis of articulation. Such a third axis of articulation is oriented in particular perpendicular to both the first-mentioned axes of articulation. In a further advanced embodiment, the third axis of articulation can intersect even the intersection point of both the first-mentioned axes of articulation. A ball joint can be a particularly simple implementation of such an articulation device.

A ball joint can also be used if pivoting the door about two axes is desired.

To facilitate the opening movement of the motor vehicle door, according to the invention at least one pressure spring can be operative between the vehicle bodywork and the door fitting component to ease upward swinging of the motor vehicle door.

In particular, articulation of the pressure spring on the door fitting component can be obtained by means of a type of ball joint.

In a further embodiment of the invention, it can be provided that the connection between the pressure spring and the door fitting component and/or the bodywork has a position with a dead center. Said position is preferably located such that shortly before the position of the completely closed door, the closing movement of the motor vehicle door is supported by the pressure spring.

BRIEF DESCRIPTION OF THE DRAWINGS

Further features, details and advantages of the invention will become apparent from the claims and the summary, the wording of both is incorporated into the contents of the description by reference, the following description of preferred embodiments of the invention and the drawings. Herein show:

DETAILED DESCRIPTION OF THE INVENTION

Figure 1:
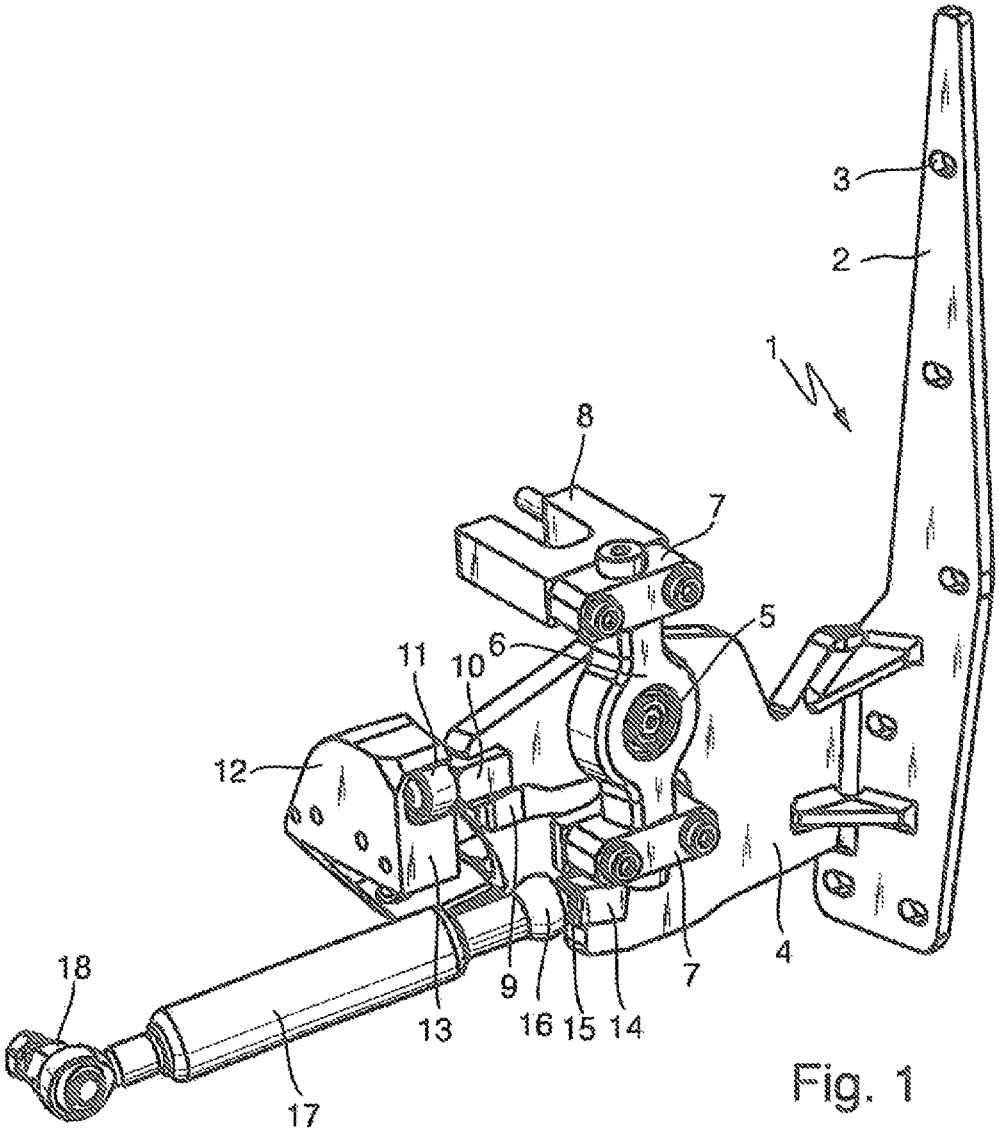
FIG. 1 a view of the hinge device in the closed condition.

FIG. 1 shows the hinge device in an oblique front view without the bodywork to which the hinge device is mounted, and without the door. The hinge device is illustrated in the closed condition. The hinge device includes a fitting component 1 which is mounted to the motor vehicle door. The fitting component 1 is composed of an elongated hinge component 2 provided with a plurality of holes 3. Said planar hinge component 2 is screwed to the door, and the holes 3 are intended therefor. In the lower portion of the hinge component 2, approximately orthogonal relative thereto, is fixed a second hinge component 4 extending approximately in parallel to the exterior of the vehicle body and spaced relative thereto, in the closed condition of the hinge device. On the front side of the second hinge component 4, a bearing pin 5 is provided and forms an articulated joint with an axis extending perpendicular to the front of the second hinge component 4. Said articulated joint is retained in an axis component 6 such that the hinge component 4 together with the hinge component 2 can turn around the axis of the bearing pin 5. Thus, the axis of the bearing pin 5 constitutes a first axis of articulation.

On both ends the axis component 6 is supported in a bearing block 7 in a rotary and axially undisplaceable manner. Thereby, the axis component 6 can be turned around its distinct longitudinal axis relative to the bearing blocks 7. The two bearing blocks 7 are each fixed to an exterior side of the bodywork using a spacer component 8 and 9, respectively. Fixing to the bodywork is not illustrated in the Figures.

The first articulated joint formed by the bearing pin 5 has an axis of articulation intersecting the axis of articulation of the bearing blocks of the axis component 6. Both the axes of articulation extend perpendicular on to the other.

Owing to the attachment of the bearing blocks 7 to the vehicle bodywork, the axis component 6 can be turned around the distinct longitudinal axis thereof, with the result of turning the fitting component 1. Simultaneously, the fitting component 1 can be turned around the axis of the bearing pin 5.

The second hinge component 4 extending approximately in parallel to the vehicle bodywork continues on the side of the bearing pin 5 facing away from the first hinge component 2. On the free end, the second hinge component 4 has a protruding insert 10 with a roller 11 supported thereon. The rotary axis of the roller 11 extends through the intersection point of the rotary axis of the bearing pin 5 with the rotary axis of the axis component 6.

The roller 11 engages a guideway of a guiding block 12, as illustrated later on, fixed to the vehicle bodywork. On the front side 13 of the guiding block 12 facing away from the bodywork, the guideway is open.

The second hinge component 4 has a second insert 14, including a ball head 15, below the insert 10 with the roller 11 and below the lower bearing block 7. In engagement with the ball head 15 is the front end 16 of a gas pressure spring 17, with the other end 18 of the spring screwed to the front side of the vehicle body. The gas pressure spring applies on the fitting component 1.

Figure 2:
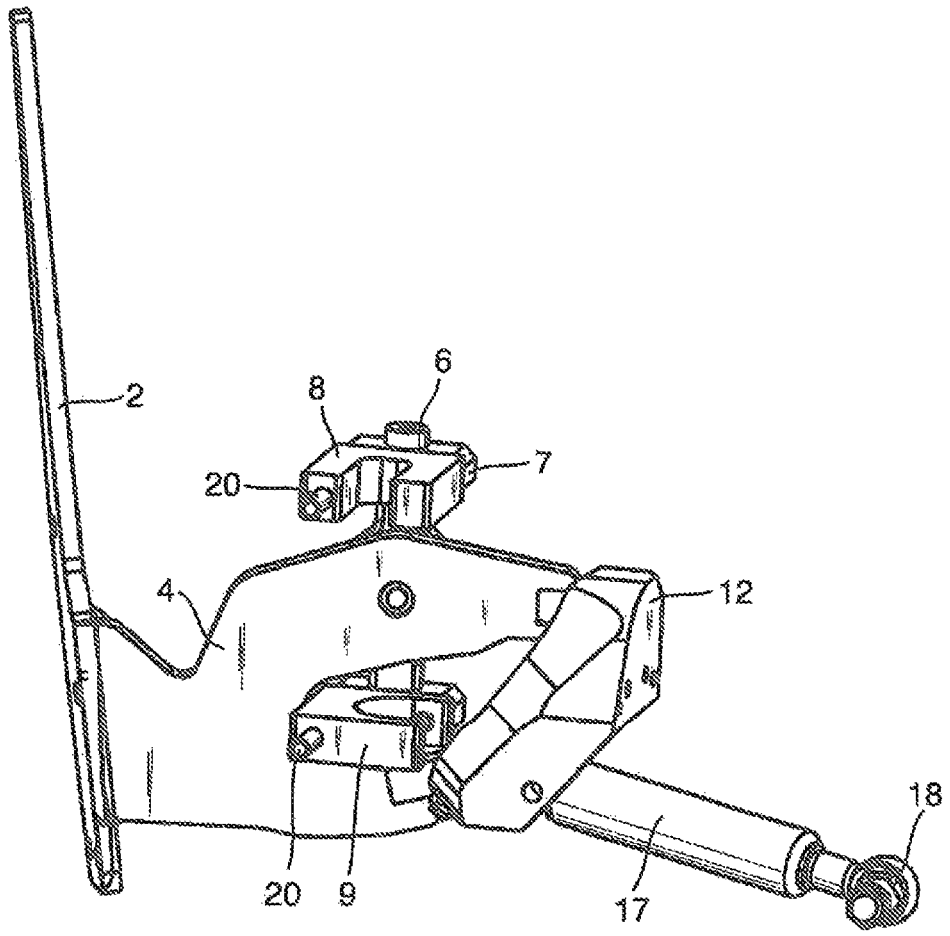
FIG. 2 a view of the hinge device from the direction of the bodywork.

For a better understanding, FIG. 2 shows the arrangement according to FIG. 1 from the rear side that is, as seen from the bodywork. It is apparent that both the bearing blocks 7 of the axis component 6 are each provided with a spacer component 8 and 9, respectively, by means of which the axis component 6 is fixed to the bodywork. Indicated are pins 20 to illustrate the connection. Both the spacer components 8 and 9 are approximately U-shaped, with the arrangement designed such that the upper spacer component 8 is fixed to the bodywork with the ends of the legs, while the lower spacer component 9 is fixed to the bodywork with one leg. Also illustrated is the guiding block 12.

Figure 3:
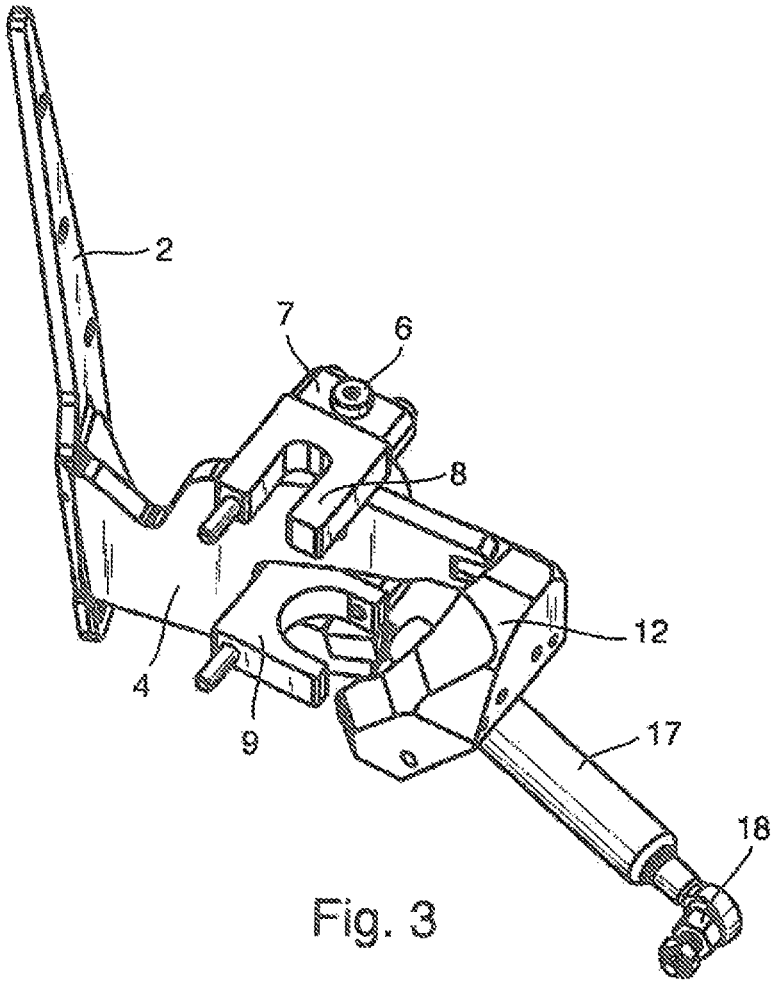
FIG. 3 an oblique top view of the hinge device in the closed condition.

FIG. 3 shows the arrangement from another perspective, namely in an oblique rear view and top view. Again, the upper end of the axis component 6, which is rotatingly supported in the bearing block 7, is clearly visible.

Figure 4:
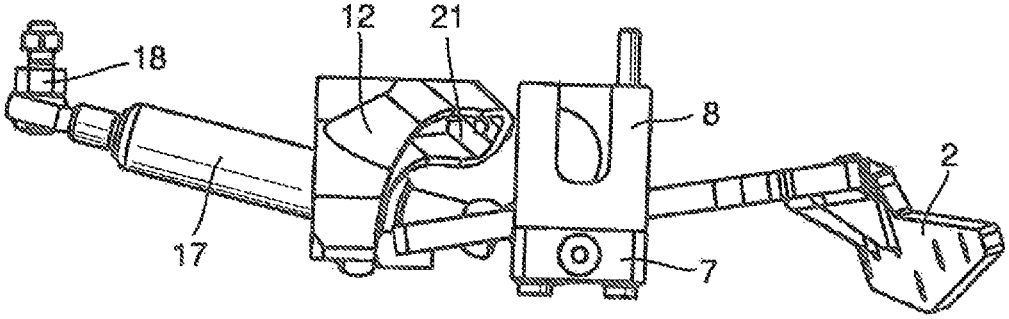
FIG. 4 a top view of the hinge device.

And finally, FIG. 4 shows the arrangement in a top view, where the vehicle bodywork is disposed in the upper zone of FIG. 4. Apparent is a first illustration of a guideway 21 in the guiding block 12, where the roller 11 engages on the insert 10. Also apparent is therein that the insert 10 and thus the rotary axis of the roller 11 is oblique relative to the planar second hinge component 4 in such a manner that the rotary axis of the roller 11 extends through the rotary axis of the axis component 6.

The FIGS. 1 to 4, as described so far, show the hinge device in the closed position of the hinge device.

Figure 5:
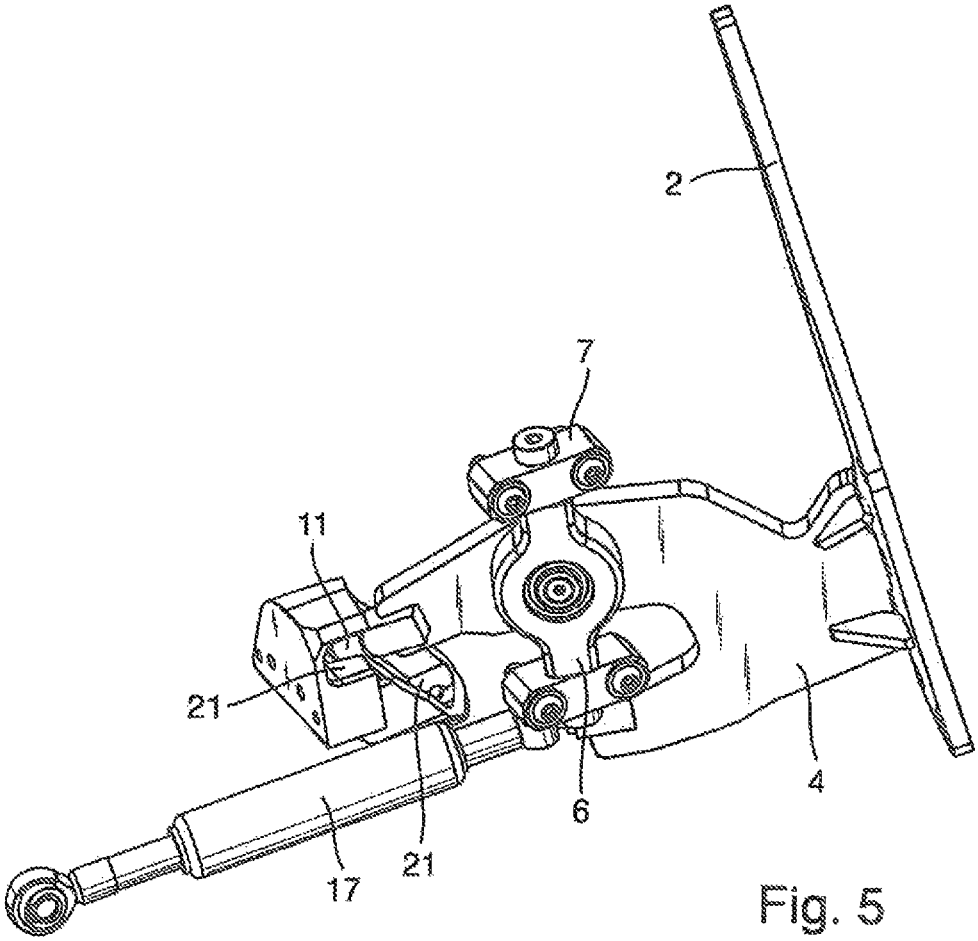
FIG. 5 a view of the hinge device in a partially opened condition.

With reference to FIG. 5, the hinge device is shown from the same direction as in FIG. 1, while now the hinge device has been opened to some extent. The axis component 6 is somewhat turned, as apparent in comparison to FIG. 1, corresponding to a partial opening of the hinge device. Therein, the roller 11 is displaced rearwards in the guideway 21. Since the width of the guideway 21 is approximately correspondent to the diameter of the roller 11, this means that the course of the guideway 21 determines the kind of movement of the vehicle bodywork fitting component 1.

Figure 6:
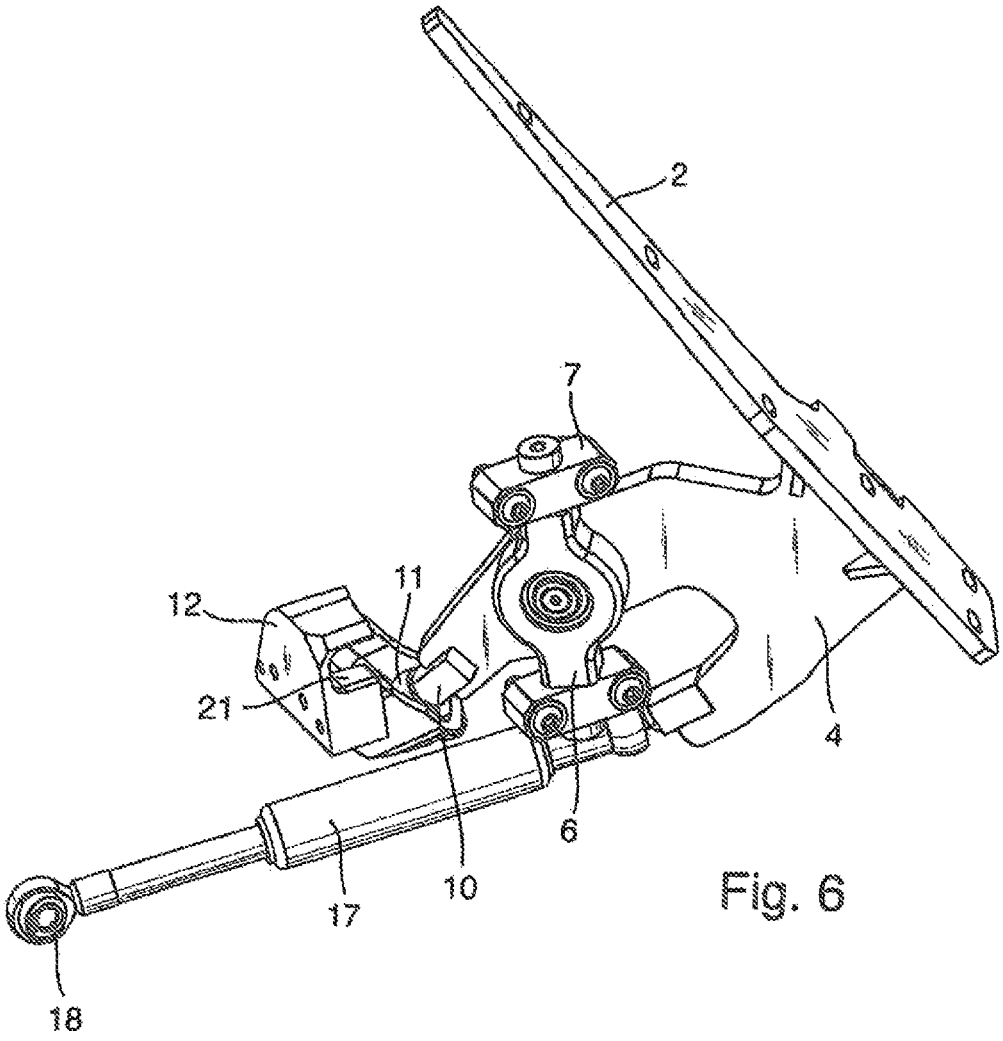
FIG. 6 an illustration corresponding to FIG. 5 of the hinge device in an almost completely opened condition.

During the further progress of the opening movement of the hinge device, the roller 11 approaches the end of the guideway 21 with the result that then the maximum opening position of the hinge device is reached. FIG. 6 gives an illustration thereof. The end of the guideway 21 corresponding to the maximum opening position of the hinge device is closed such that a stop is constituted thereby. In addition, a stop screw can be provided, and is apparent in FIG. 5. By means of the screw, the opening position of the hinge device and thus of the door of the motor vehicle can be adjusted.

Figure 7:
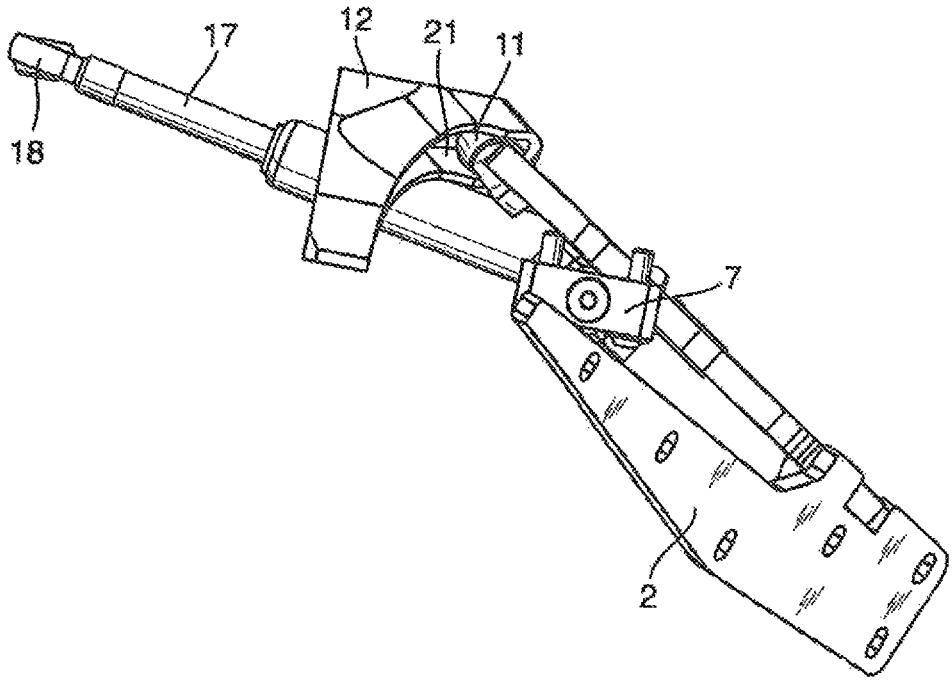
FIG. 7 a top view of the completely opened hinge device.

The maximum opened position of the hinge device is illustrated in FIG. 7 also in a view directly from above. Therein, the spacer component 8 is omitted for simplification. It is also apparent therein that the roller 11 has arrived at the end of the guideway 21.

Figure 8:
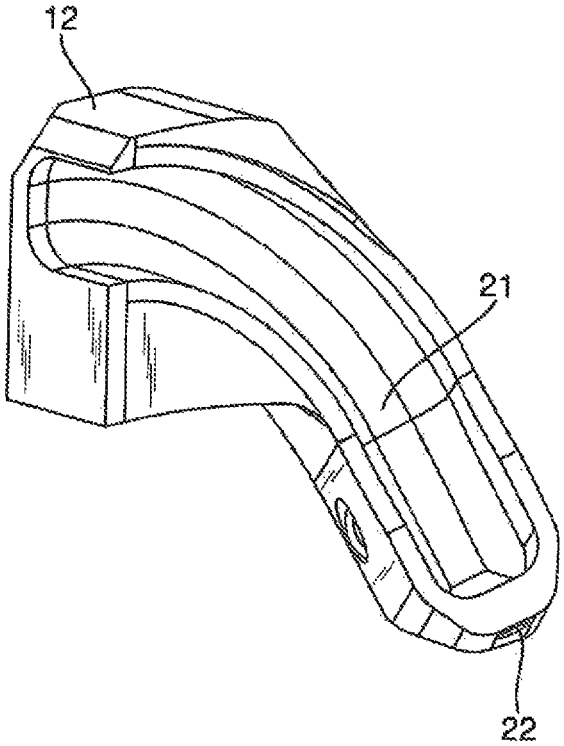
FIG. 8 an enlarged scale illustration of the guideway.

The guideway 21 disposed in the guiding block 12 is again illustrated in FIG. 8 in an enlarged scale. The guideway 21 is a grove having two grove flanks extending in parallel to another. The mutual distance between the groove flanks is constant and corresponding approximately to the diameter of the roller 11. However, the roller 11 is always resting on only one flank of the guideway 21. The opening movement of the door fitting component 1 and thus of the door can be defined exactly by the course of the guideway 21. In addition, the closed end of the guideway 21 prevents an excessive opening of the door. As illustrated in the lower zone of FIG. 8, a threaded hole 22 for inserting a stop screw is provided to allow adjusting of the stop position at the end of the guideway 21.

Figure 9:
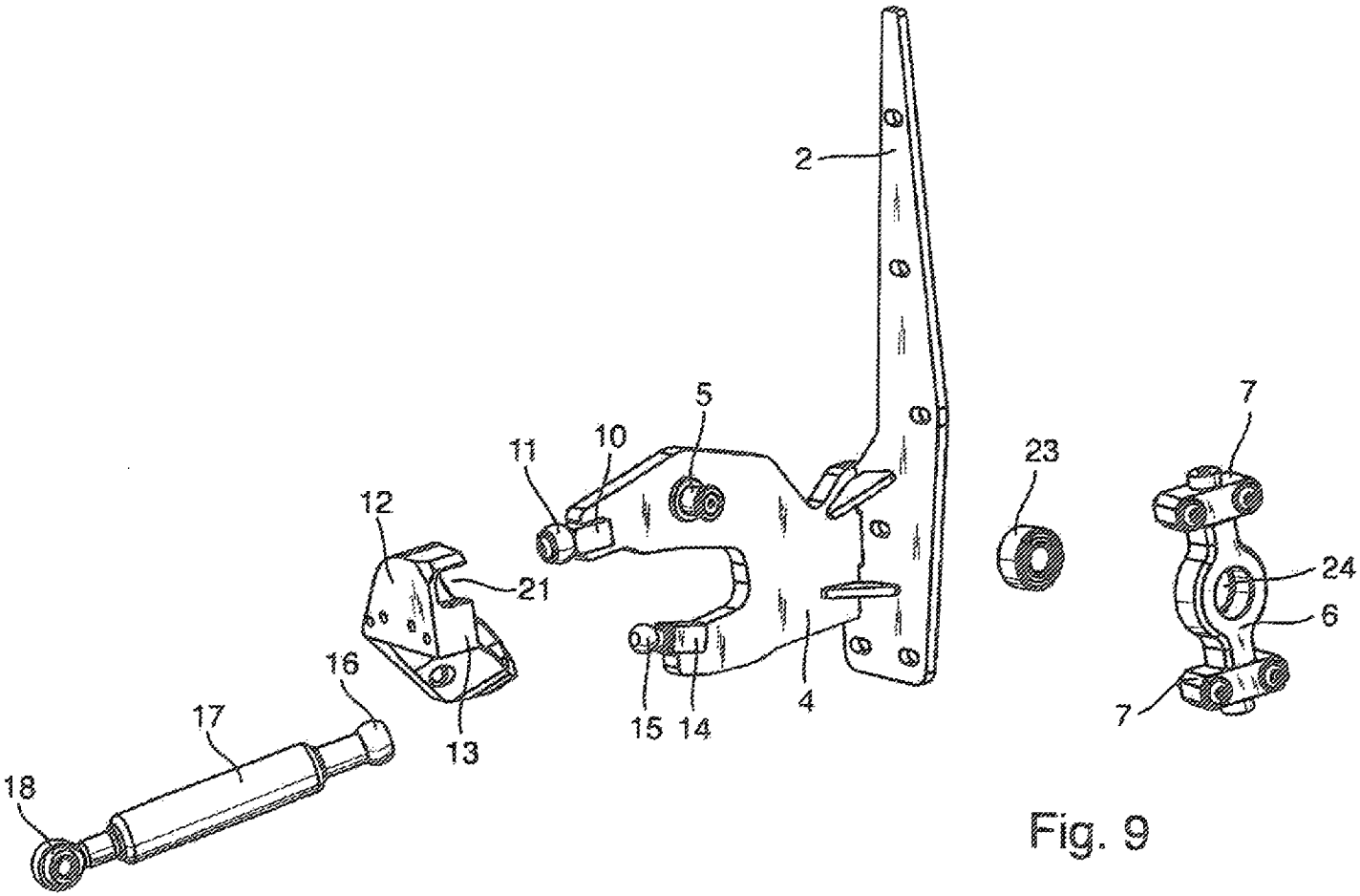
FIG. 9 individual components of the hinge device.

FIG. 9 shows all the individual components of the hinge device separately. Illustrated on the second hinge component 4 are the two inserts 10 and 14, with the one insert 10 supporting the roller 11.

The second insert 14, disposed in a lower position, has a ball head 15 engaging in the front end 16 of the gas pressure spring 17 designed in a ball socket shape.

The bearing pin 5, projecting perpendicularly on the planar front, side of the hinge component 4, cooperates with a bearing 23 which is inserted in a bearing hole 24 of the axis component 6. Thereby, the axis component 6 is supported to be rotating around the bearing pin 5.

The bearing pin 5 together with the bearing 23 constitutes an articulated joint including a first axis of articulation coinciding with the axis of the bearing pin 5. The axis component 6 rotatingly supported in the bearing blocks 7 constitutes a second articulated joint including a second axis of articulation. Both the axes of articulation are perpendicular to each other and intersecting.

Now referring to the embodiment as illustrated in the FIGS. 10 to 13. While in the above embodiment the hinge device is fixed directly to the bodywork of the motor vehicle, the now described embodiment makes use of an additional vehicle body component. Even retrofitting of the hinge device to motor vehicles is enabled thereby.

Figure 10:
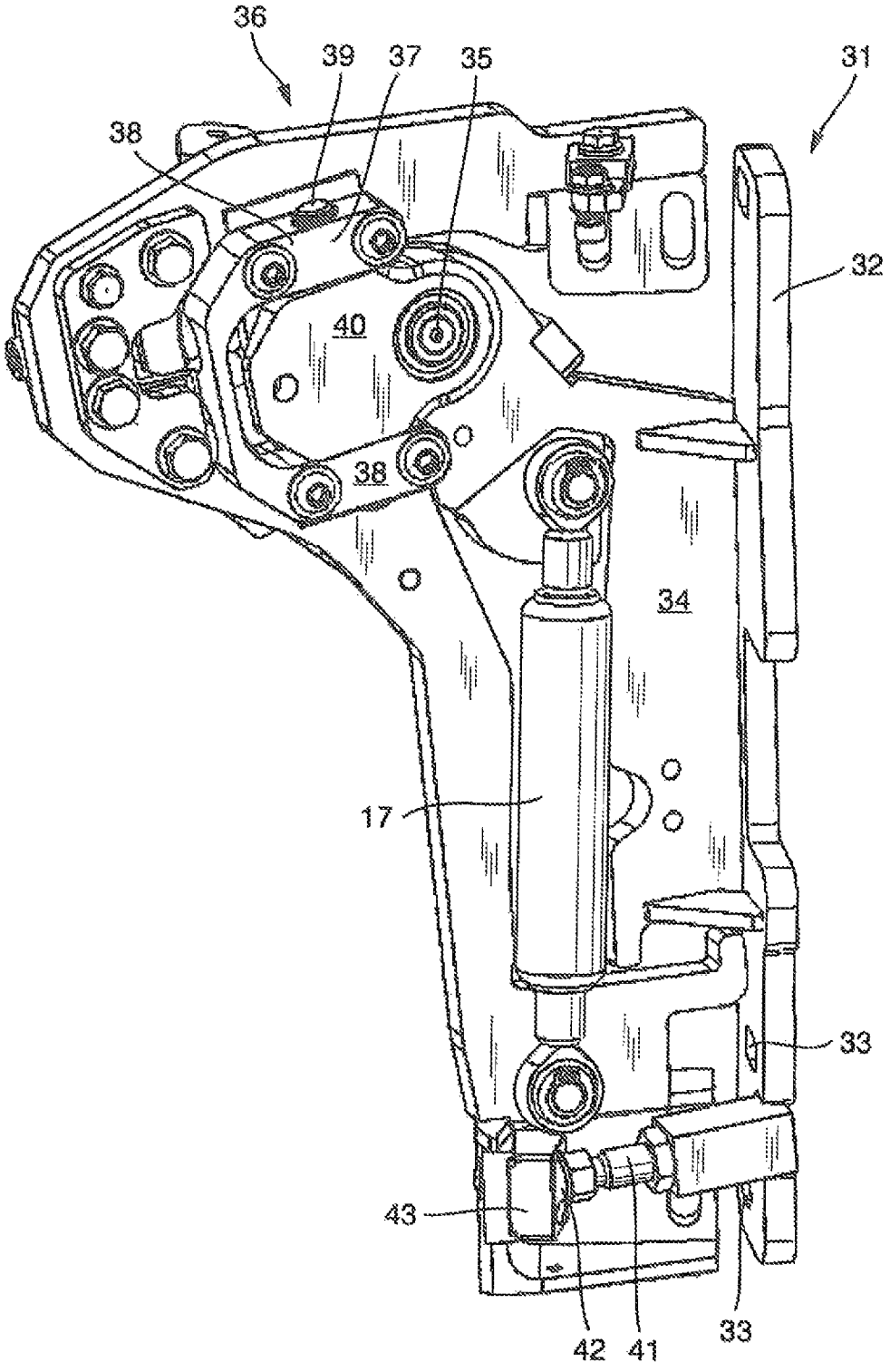
FIG. 10 an illustration corresponding to FIG. 1 of a second embodiment of the hinge device in the closed condition.

FIG. 10 shows, similar to FIG. 1, a view of the hinge device as proposed by the invention in a view directed to the motor vehicle in the closed condition. The hinge device includes a first fitting component 31 intended for fixing on the door of the motor vehicle and thus may also be designated door fitting component. Said fitting component 31 includes a first hinge component 32 in the form of a planar plate provided with holes 33. Said hinge component 32 is thus screwed to the door using the holes 33. A second hinge component 34 is fixed to said hinge component 32, and also presenting approximately the shape of a planar plate extending perpendicular to the plane of the first hinge component 32.

In the upper portion of the second hinge component 34, a bearing pin 35 is attached which extends perpendicular to the second hinge component 34 and constitutes part of an articulated joint.

A second fitting component 36 is associated to the hinge device and intended for fixation to the bodywork, and thus is also designated as bodywork component 36 in the description hereinbelow. An approximately U-shaped mount 37 is screwed to the bodywork component 36 and an articulated shaft 39 extends between the legs 38 of the mount parallel to the plane of the bodywork fitting component 36. Only the upper end of the articulated shaft 39 is illustrated in FIG. 10. By means of the articulated shaft 39, an articulation shoulder 40 is pivoted between the legs 38 of the mount 37, and thus pivotable around the axis of the articulated shaft 39. The articulation shoulder 40 includes a pivot bearing for the bearing pin 35 spaced from the axis of the articulated shaft 39. The mount 37 with its articulated shaft 39, the articulation shoulder 40 and the bearing pin 35 constitutes an articulation device to connect the door fitting component 31 to the bodywork fitting component 36. The two components can be turned around the axis of the articulated shaft 39 and pivoted around the axis of the bearing pin 35. Both these movements are in the first instance independent one from the other.

On the lower end, the hinge component 32 of the door fitting component 31 includes an orthogonally protruding pin 41 adjustable in length and including a ball head 42 at its end. The bodywork fitting component 36 includes a ball socket 43 in its lower end zone for the ball head 42 of the pin 41 to engage in the closed position of the hinge, as illustrated. During pivoting of the door fitting component 31 around the axis of the bearing pin 35, the ball head 42 is disengaged from the ball socket 43. During turning of the door fitting component 31 around the axis of the articulated shaft 39, the ball head 42 remains in the ball socket 43.

A gas pressure spring 17 extends between the second hinge component 34 of the door fitting component 31 and the lower portion of the bodywork fitting component 36, said spring being articulated at both ends.

Figure 11:
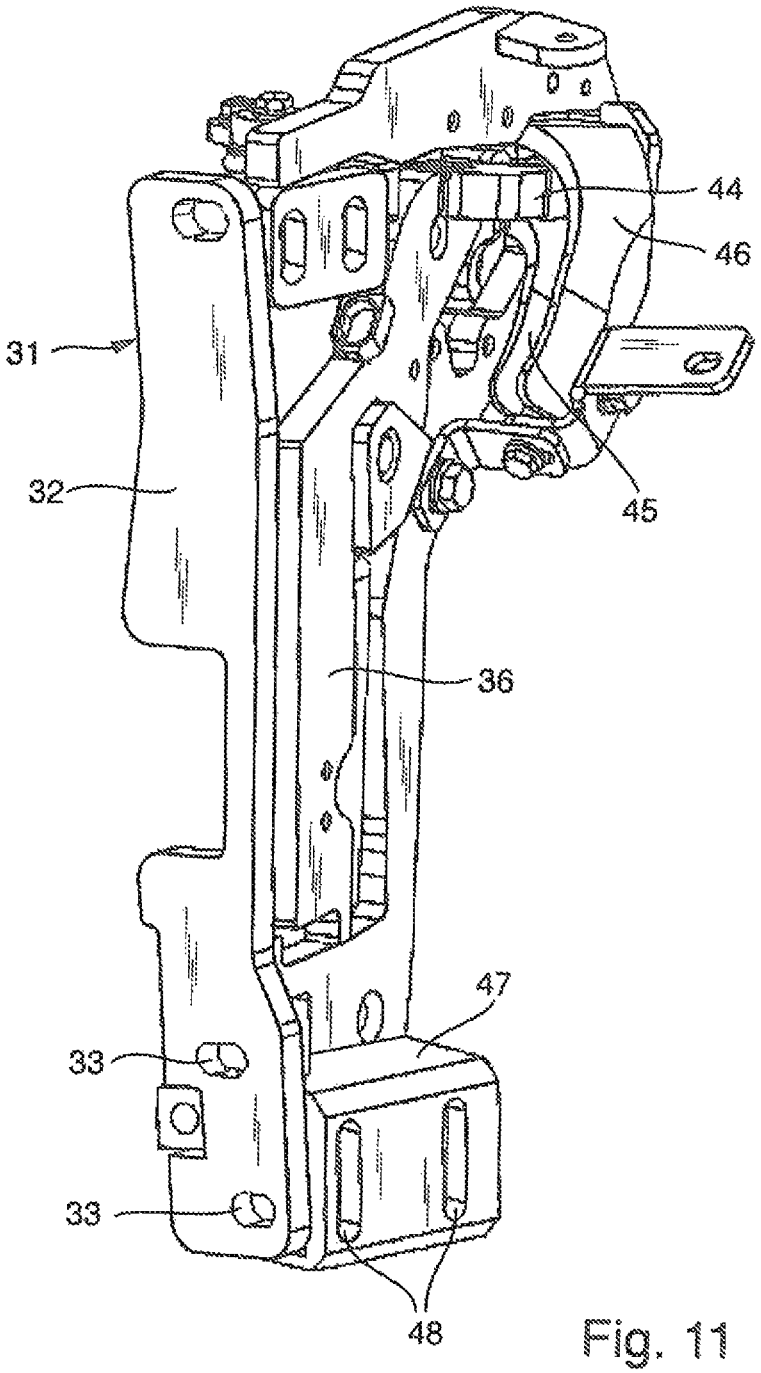
FIG. 11 an oblique rear view of the hinge device according to FIG. 10.

Now with reference to FIG. 11, wherein the arrangement of FIG. 10 is shown in an oblique rear view. A mount 44 is fixed in the upper portion of the rear side of the door fitting component 31 facing the bodywork, and has a guiding element on the free end thereof, almost concealed in FIG. 11. A guiding component 46 is fixed on the rear side of the bodywork fitting component 36 facing the bodywork, and has a guideway 45 approximately U-shaped in cross, section. The guiding element associated to the door fitting component 31 is guided through the guideway 45 during movement of the door fitting component 31. As a result, compulsory movement of both the fitting components 31, 36 is caused such that the initially given independence of the two components of the hinge device is removed thereby.

The bodywork fitting component 36 has on the lower end thereof a protrusion 47 directed towards the vehicle body and including two elongated holes 48 for fixing the fitting component to the bodywork.

Figure 12:
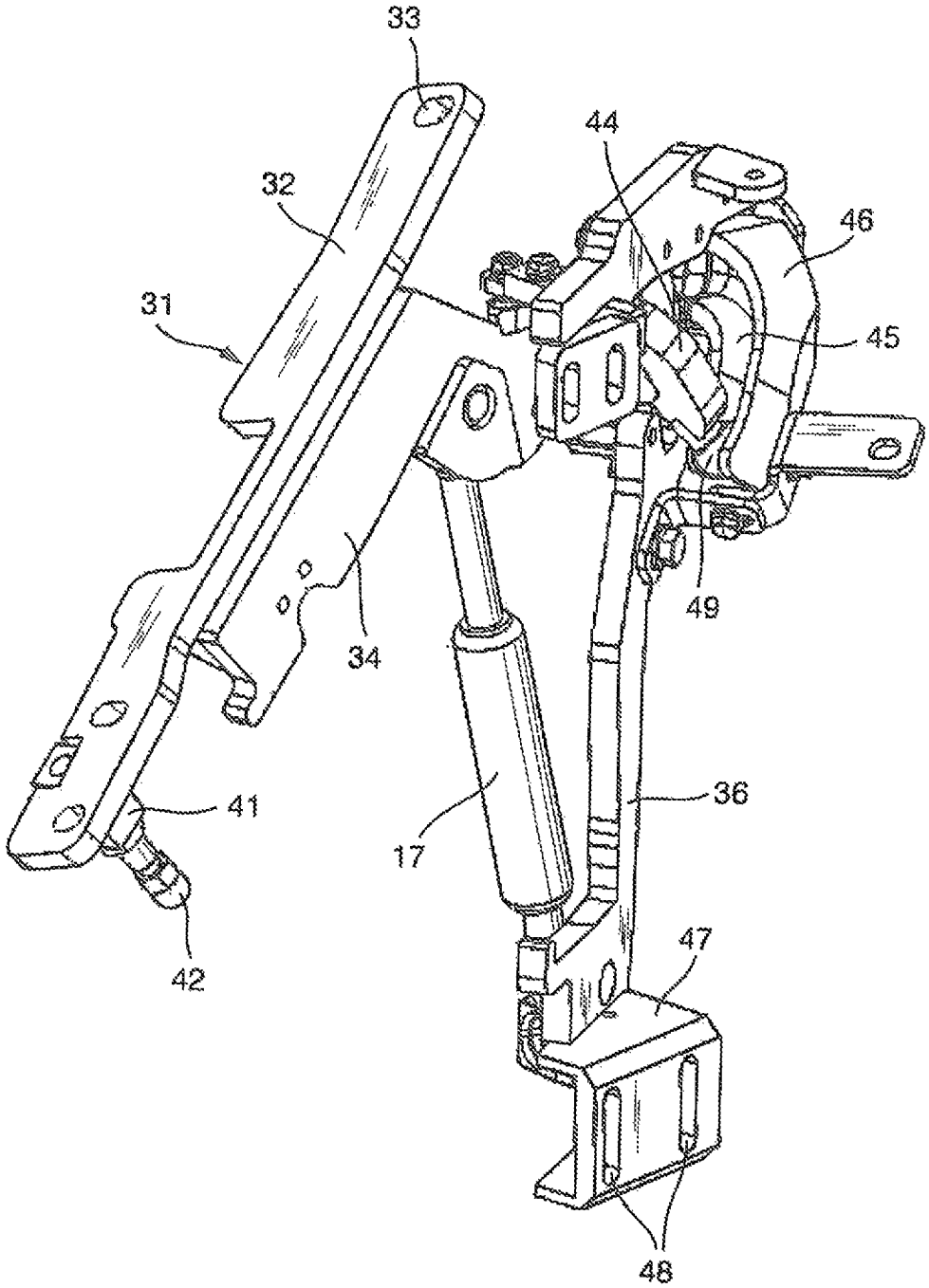
FIG. 12 a rear view of the hinge device according to FIGS. 10 and 11 in a partially opened condition.

So when the door fitting component 31, or to be more precise the door, is opened, the door fitting component 31 assumes the position as illustrated in FIG. 12. It is apparent from FIG. 12 that the mount 44 attached to the door fitting component 31 has changed its position together with the guiding element 49 such that now the guiding element 49 has reached the end of the guideway 45. Since the guideway 45 has an approximately U-shaped cross sectional design and the inner spacing of the two legs of the guideway is approximately correspondent to the diameter of the guiding element 49, the guideway 45 is a guidance for pivoting the door fitting component 31. As a result, the kinematics of the movement of the door fitting component 31 and thus of the door of the motor vehicle are determined by the shape and arrangement of the guideway 45.

Figure 13:
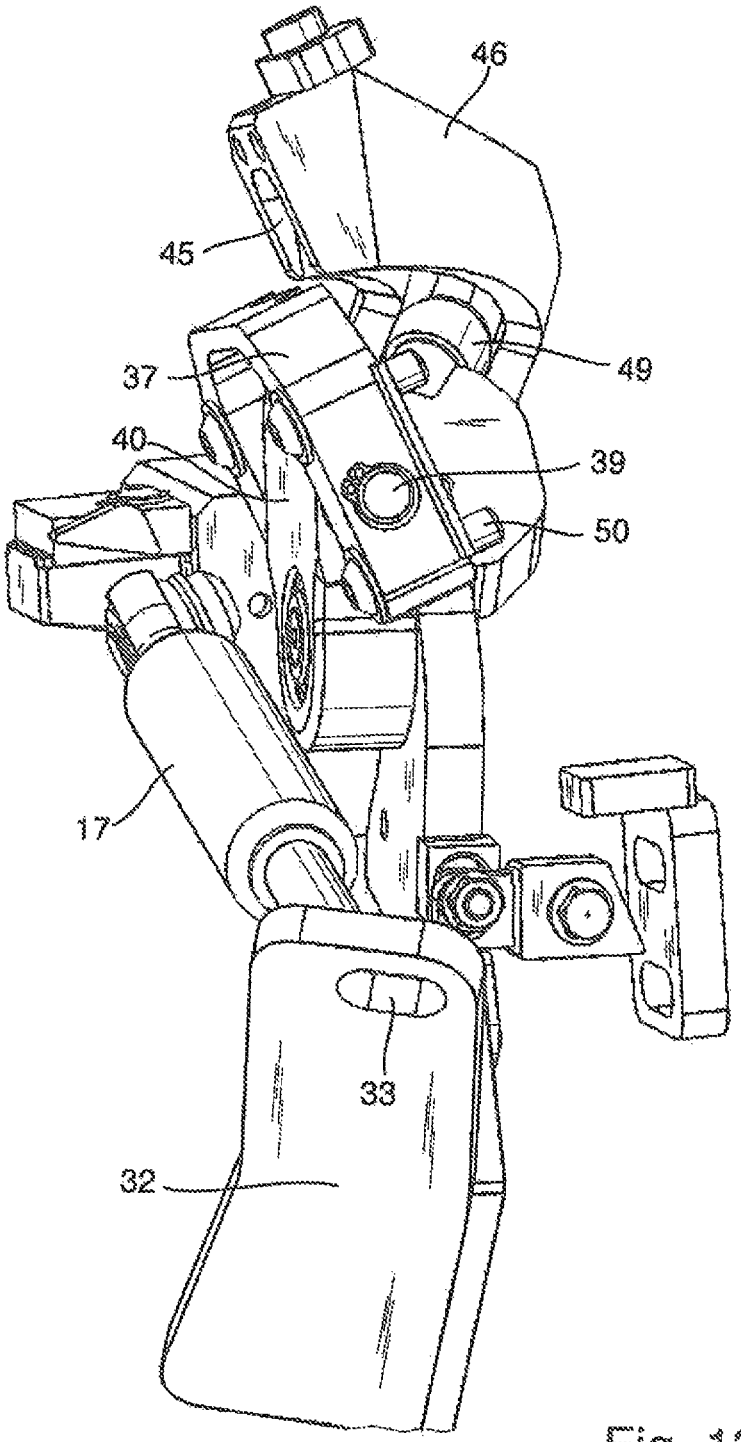
FIG. 13 a partial oblique top view of the hinge device according to FIGS. 10 to 12.

In FIG. 13 a top view of the hinge device in sections is shown. For reasons of simplification, the bodywork component 36 has been omitted and only the elements attached to the bodywork component 36 are illustrated. It is apparent thereform, how the articulation shoulder 40 is pivoted relative to the U-shaped mount 37. Also apparent is the engagement of the guiding element 49 in the guideway 45. The guiding component 46 including the guideway 45 is an additional component to be fixed to the rear side of the bodywork component 36. Screws 50 used for screwing on the U-shaped mount 37 are as well visible in FIG. 13.

Features illustrated and described in relation to one embodiment, may also be used with any other embodiment.

The invention claimed is:

1. A hinge device for a motor vehicle door, comprising a door fitting component (1) intended for mounting on the door, and an articulation device connecting the door fitting component (1) to a vehicle bodywork, the articulation device including a first articulated joint component connected to the door fitting component, with at least one first axis of articulation and a second articulated joint component connected to the first articulated joint component, with at least one second axis of articulation, an insert component having a guiding element (11) adapted to be connected to one of the vehicle bodywork or the door fitting component (1), and a guide block having a guideway (21) adapted to be connected to the other one of the door fitting component (1) or the vehicle bodywork and cooperating with the guiding element (11), wherein the guiding element (11) is in movable engagement with the guideway (21) during a maximum opening or closing movement of the door fitting component (1) relative to the articulation device, and further wherein the guideway (21) is a groove.

2. The hinge device according to claim 1, wherein the guiding element (11) is arranged on the door fitting component (1) and the guideway (21) is adapted to be connected to the vehicle bodywork.

3. The hinge device according to claim 1, wherein the axes of articulation of both the articulated joint components are oriented perpendicular to each other.

4. The hinge device according to claim 1, wherein the two axes of articulation are intersecting in the articulation device.

5. The hinge device according to claim 4, wherein the articulated joint components of the articulation device are configured in a ball joint.

6. The hinge device according to claim 1, wherein the guiding element (11) is slidably guided in the guideway (21) during said opening or closing movement.

7. The hinge device according to claim 1, wherein the guiding element includes at least one roller (11).

8. The hinge device according to claim 7, wherein the rotary axis of the roller (11) is perpendicular to the axes of articulation of both the articulated Joint components.

9. The hinge device according to claim 8, wherein the rotary axis of the roller (11) intersects the intersection point of both the axes of articulation.

10. The hinge device according to claim 1, comprising a pressure spring (17) adapted to be operatively disposed between the vehicle bodywork and the door fitting component (1) to support the opening movement of the door fitting component (1).

11. The hinge device according to claim 10, wherein the pressure spring is in a dead center position when the hinge device is within a short distance to a closed position.

12. The hinge device according to claim 11, wherein the articulation device includes a third articulated joint, disposed between said pressure spring and said articulation device, having a third axis of articulation.

13. The hinge device according to claim 1, wherein the articulation device and optionally the guideway (45) are fixed to a bodywork component (36) which is connectable to the bodywork of the motor vehicle.

* * * * *